United States Patent [19]

Sauer

[11] 4,223,416

[45] Sep. 23, 1980

[54] BOOT SUPPORT

[76] Inventor: Robert J. Sauer, P.O. Box 187, Holbrook, Mass. 02343

[21] Appl. No.: 18,126

[22] Filed: Mar. 7, 1979

[51] Int. Cl.[3] ..... A43D 5/00; A43B 3/26

[52] U.S. Cl. ..... 12/114.6; 36/97

[58] Field of Search ..... 12/114.2, 114.6, 114.8, 12/128 R; 36/97

[56] References Cited

U.S. PATENT DOCUMENTS

| | | | |
|---|---|---|---|
| 823,853 | 6/1906 | Essen | 12/114.6 |
| 2,497,175 | 2/1950 | Mantos | 36/97 |
| 2,770,936 | 1/1942 | Doering et al. | 12/114.6 |
| 3,681,804 | 8/1972 | Caputo | 12/114.6 |

*Primary Examiner*—Patrick D. Lawson

*Attorney, Agent, or Firm*—Thompson, Birch, Gauthier & Samuels

[57] ABSTRACT

A boot support comprises an elongated one-piece solid plastic member having a shape generally approximating that portion of a human leg between the ankle and knee. The member has a plurality of sets of oppositely facing horizontal grooves located at selected levels measured from the base of the member. The groove sets establish break-off locations for reducing the overall height of the member to accommodate different boot heights.

4 Claims, 3 Drawing Figures

BOOT SUPPORT

TECHNICAL FIELD

This invention relates generally to supports for the flexible tops of boots.

BACKGROUND OF THE PRIOR ART

The prior art relating to boot supports is extensive, as evidenced by U.S. Pat. Nos. 258,917 (Hawley); 400,876 (Stead); 823,853 (Von Essen); 1,668,219 (Sherman); 1,828,937 (Niemi); 2,529,565 (Mills); 3,483,580 (Cherry et al) and 3,681,804 (Caputo).

The fluid expandable boot supports shown in the patents to Hawley, Stead and Cherry et al have the disadvantage of being subject to puncture or rupture. The mechanically expandable types shown in the patents to Von Essen, Sherman, Niemi and Mills are relatively expensive to manufacture. The one-piece type shown in the patent to Caputo is an improvement over the foregoing types in that it is relatively rugged and inexpensive to manufacture. However, problems still remain with the Caputo support. For example, the manner of gripping the Caputo support in order to extract it from a boot makes it necessary to have the support protrude above the boot top. This in turn makes for an unsightly combination, which is particularly undesirable in commercial displays where the primary objective is to highlight the attractiveness of the boot. Also, the Caputo support is not readily adaptable to the range of standard boot heights normally encompassed by current fashion trends. In addition, the Caputo support inhibits ventilation and drying of the lower boot interior.

BRIEF SUMMARY OF THE PRESENT INVENTION

The present invention avoids the problems mentioned above by providing an improved boot support consisting of a plastic one-piece frangible member which is relatively rugged, inexpensive to manufacture, and which embodies a plurality of vertically spaced sets of oppositely facing horizontal grooves. These groove sets provide break-off locations for reducing the overall height of the support to accommodate different boot heights.

Preferably, the boot support of the present invention also includes a vertical forwardly facing groove which acts as an air shaft to ventilate and dry the lower boot interior.

Preferably, the boot support of the present invention further includes an integrally molded handle protruding vertically from its top surface. This handle is accessible by reaching into the boot, thus obviating the necessity of having the boot support protrude above the boot top.

DETAILED DESCRIPTION OF PREFERRED EMBODIMENT

Figure 3:
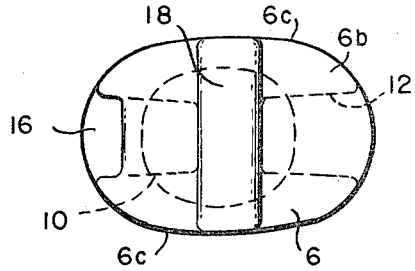
FIGS. 2 and 3 are front elevational and top plan views respectively of the boot support shown in FIG. 1.
Figure 2:
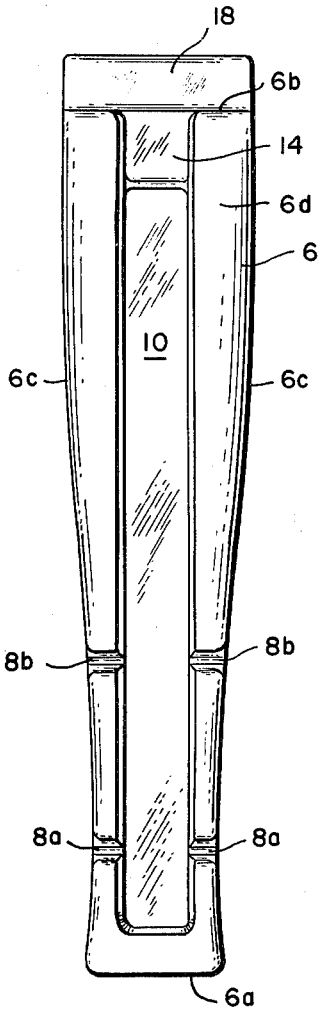
Figure 1:
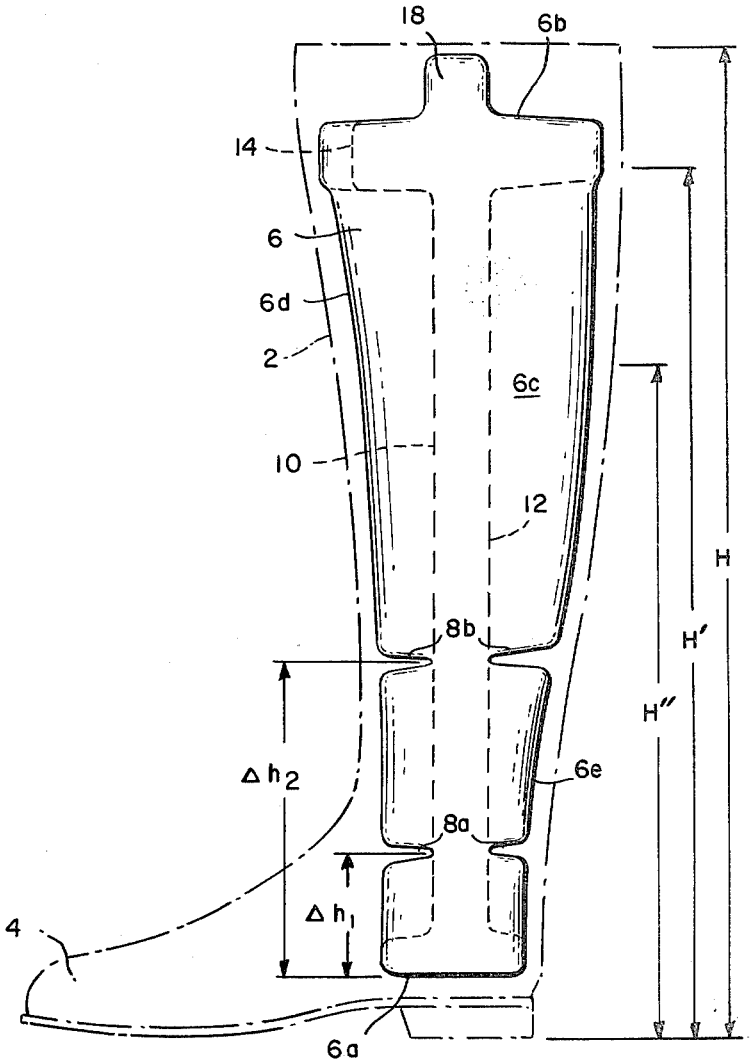
FIG. 1 is a side elevation of a boot support in accordance with the present invention, with the boot shown in dot-dash lines.

Referring now to the drawings, a typical boot is shown having an upper flexible portion 2 and a lower foot portion 4. The height of the upper portion 2 can vary, depending on fashion requirements. Several typical heights are depicted in FIG. 1 at H, H′ and H″.

The boot support of the present invention comprises an elongated one-piece solid plastic member 6 having a shape generally approximating that portion of a human leg between the ankle and knee. The member 6 is molded from a frangible material such as for example polystyrene, and has a bottom surface 6*a*, a top surface 6*b*, sides 6*c*, and front and rear surfaces 6*d* and 6*e*.

To facilitate illustration, the exterior surfaces of the support have been shown spaced from the interior boot surfaces. However, in actual use, it will be understood that the sides 6*c* and the front and rear surfaces 6*d*, 6*e* will contact and support the interior surfaces of the upper flexible boot portion 2, and the bottom surface 6*a* will rest on the interior boot bottom.

The member 6 is further provided with a plurality of sets of oppositely facing horizontal grooves 8*a*, 8*b* which are located at selected levels $\Delta h_1$ and $\Delta h_2$ from the bottom surface or base 6*a*. The purpose of the horizontal groove sets will hereinafter be described in greater detail.

The member 6 further includes forwardly and rearwardly facing vertical grooves 10 and 12, the upper and lower ends of which terminate respectively at locations spaced vertically from the top and bottom surfaces 6*d* and 6*a*.

Preferably the horizontal groove sets 8*a*, 8*b* face forwardly and rearwardly, with their depths being approximately equal respectively to the depths of the forwardly and rearwardly facing vertical grooves 10, 12.

Preferably, the forwardly facing vertical groove 10 is connected via an upward relatively shallow extension 14 to an opening 16 in the top surface 6*b*. The boot support preferably further includes an integrally molded handle 18 protruding vertically from the top surface 6*b*.

As shown in FIG. 1, the maximum overall height of the boot support is such that with a boot having a height H, the top of the handle 18 and the top surface 6*b* are located out of sight beneath the top boot edge. The handle 18 is accessible by reaching into the boot top, thus providing a convenient menas of inserting and withdrawing the boot support without detracting from the appearance of the overall combination.

The boot support may also be employed with shorter boots having heights of H′ and H″. For a boot having a height H′, the user merely reduces the height of the member 6 by a distance of $\Delta h_1$. This is done by breaking off the bottom section of the boot support at the level of the horizontal groove set 8*a*.

Similarly, if a still shorter boot having a height H″ is to be supported, then the user will break off a section at the horizontal groove set 8*b*, thus reducing the height of the boot support by a net distance $\Delta h_2$. The number and spacing of the horizontal groove sets 8 can of course be varied to suit existing commercial requirements. By having the depths of the horizontal groove sets 8*a*, 8*b* approximately equal to depths of the vertical grooves 10, 12, a relatively clean break-off is achieved without having to resort to the use of knives or other cutting implements.

The forwardly facing vertical slot 10 and its shallow upper extension 14 provide an air shaft for ventilating and drying the interior of the foot portion 4.

I claim:

1. A boot support comprising an elongated one-piece solid plastic member having a shape generally approximating that portion of a human leg between the ankle and knee, said member having a plurality of sets of oppositely facing horizontal grooves, each set being located at a selected level measured from the base of said member, said groove sets establishing break-off locations for reducing the overall height of said member to accommodate different boot heights, and an integrally molded handle protruding vertically from the top surface of said member.

2. The boot support of claim 1 further comprising forwardly and rearwardly facing vertical grooves, the upper and lower ends of which terminate respectively at locations spaced vertically from the top and bottom surfaces of said member.

3. The boot support of claim 2 wherein the horizontal grooves of said sets face forwardly and rearwardly with their depths being approximately equal respectively to the depths of said forwardly and rearwardly facing vertical grooves.

4. The boot support of claim 2 wherein the forwardly facing vertical groove is extended upwardly to the top surface of said member.

* * * * *